US008217262B2

(12) United States Patent
Lank

(10) Patent No.: US 8,217,262 B2
(45) Date of Patent: Jul. 10, 2012

(54) DECORATIVE COVER FOR WALL MOUNTED DEVICE

(75) Inventor: Kimberly Lank, Severna Park, MD (US)

(73) Assignee: Kimberly Lank, Severna Park, MD (US)

( * ) Notice: Subject to any disclaimer, the term of this patent is extended or adjusted under 35 U.S.C. 154(b) by 257 days.

(21) Appl. No.: 12/616,919

(22) Filed: Nov. 12, 2009

(65) Prior Publication Data

US 2011/0108303 A1 May 12, 2011

(51) Int. Cl.
*H02G 3/08* (2006.01)

(52) U.S. Cl. ..... 174/50; 174/480; 174/481; 174/520; 220/3.2; 220/4.02; 312/223.1

(58) Field of Classification Search ..... 174/480, 174/481, 50, 53, 57, 58, 17 R, 66, 67, 17 VA, 174/561, 520, 559; 220/3.2–3.9, 4.02, 241, 220/242; 248/906; 312/223.1, 223.2, 223.3, 312/248
See application file for complete search history.

(56) References Cited

U.S. PATENT DOCUMENTS 3,752,900 A * 8/1973 Harrison et al. ..... 174/50
4,683,734 A * 8/1987 Peterson ..... 174/17 VA
4,712,157 A * 12/1987 Simonson et al. ..... 174/58
4,805,073 A * 2/1989 Johnson et al. ..... 174/520
5,087,794 A * 2/1992 Nelson ..... 174/561
5,400,533 A 3/1995 Cruse
5,568,362 A * 10/1996 Hansson ..... 174/50
5,621,387 A * 4/1997 Phillips et al. ..... 174/520
5,877,450 A * 3/1999 Quin ..... 174/66
6,207,899 B1 3/2001 Gillespie
6,519,208 B2 * 2/2003 DeVries ..... 174/50
6,755,493 B1 * 6/2004 Krietzman et al. ..... 312/248
7,038,131 B1 * 5/2006 Gretz ..... 174/58
7,189,922 B1 3/2007 Rose et al.
7,227,083 B2 6/2007 Ciemny et al.
7,671,276 B2 * 3/2010 Baker ..... 174/50

OTHER PUBLICATIONS

Junkmarket Style; http://www.junkmarketstyle.com/item/6231/cover-a-thermostat; Cover a Thermostat; Jan. 8, 2009.

* cited by examiner

*Primary Examiner* — Angel R Estrada
(74) *Attorney, Agent, or Firm* — Ronald E. Prass, Jr.; Prass LLP

(57) ABSTRACT

A decorative cover for a device mounted to a wall is provided. The cover has a face panel (that may or may not include artwork or a photo) and a support structure attached to the face panel. The support structure is adapted to attach to the wall. The face panel is pivotable relative to the wall between a closed position and an open position. The cover has a top portion, the top portion has a top opening to allow air flow from an inner side of the top portion to an outer side of the top portion.

20 Claims, 5 Drawing Sheets

DECORATIVE COVER FOR WALL MOUNTED DEVICE

BACKGROUND

Disclosed herein are examples of covers for wall mounted devices such as thermostats, fuse or breaker boxes, electrical switches, door chimes, and other wall mounted devices.

An example of an application for a cover in accordance with the invention is a cover for a wall mounted thermostat.

Most homes and offices have at least one wall mounted thermostat. Usually, these thermostats are less than attractive and rarely fit in with the décor of the home or office.

SUMMARY

The disclosure describes embodiments of the invention that provide a decorative cover for a wall-mounted device such as a thermostat.

Particular embodiments of the invention provide a decorative cover for a device mounted to a wall. The cover has a face panel and a support structure attached to the face panel. The support structure is adapted to attach to the wall and the face panel is pivotable relative to the wall between a closed position and an open position. The cover has a top portion, the top portion having a top opening to allow air flow from an inner side of the top portion to an outer side of the top portion.

DETAILED DESCRIPTION

Embodiments of the invention disclosed herein relate to covers for wall mounted devices.

In many homes and offices, various useful but unsightly devices are mounted on the walls. These devices include, for example, thermostats. It would be advantageous to be able to hide the thermostats and other unsightly wall mounted devices. However, modern thermostats have sophisticated controls that need to be accessed periodically and thus any decorative cover used to hide the thermostat must be removable or otherwise allow access to the thermostat's controls.

The disclosure describes various embodiments that provide a decorative cover for a wall-mounted device while also allowing access to the device.

Figure 1:
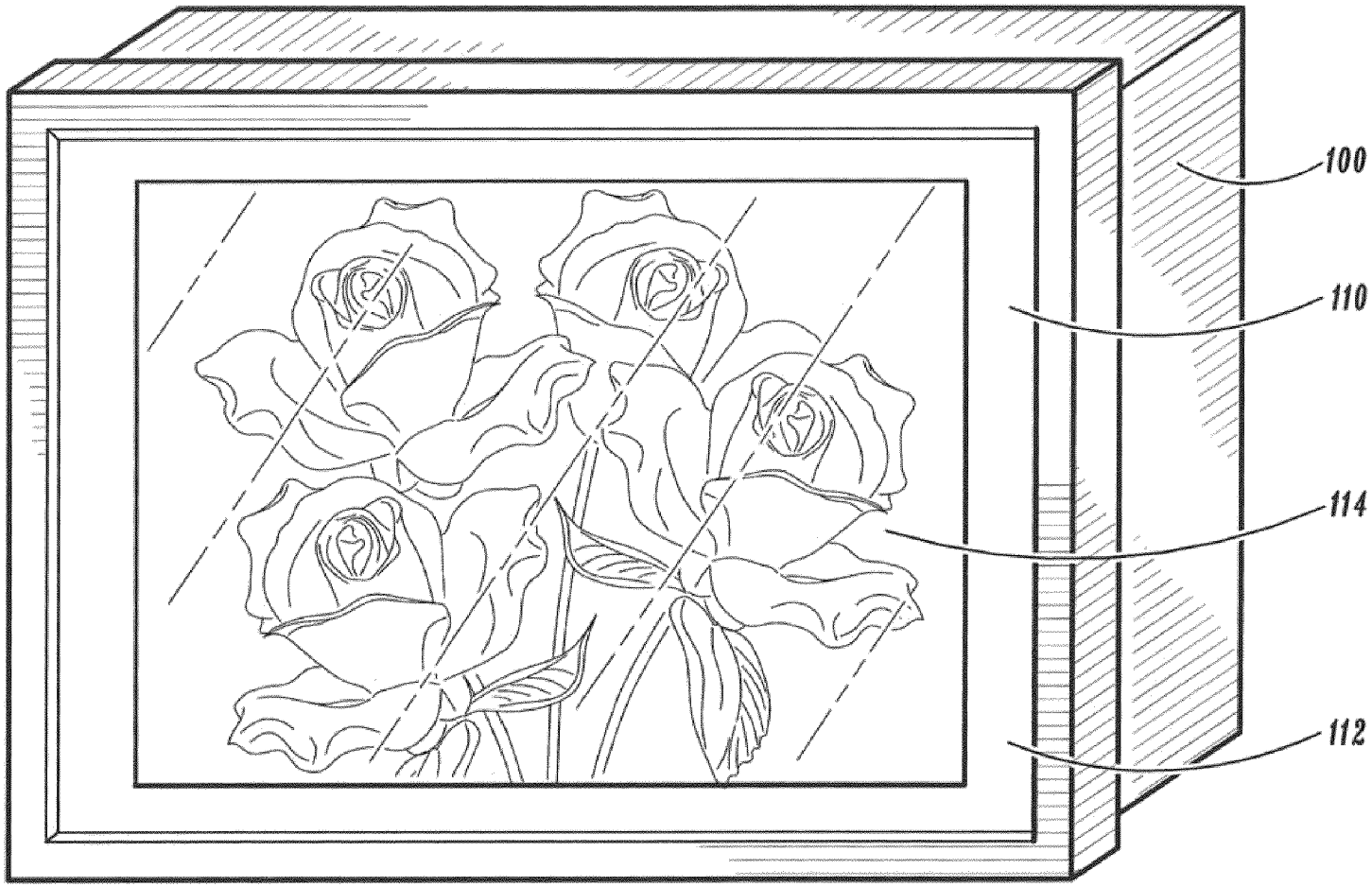
FIG. 1 is a perspective view of a first embodiment of a thermostat cover in accordance with the invention.

FIG. 1 shows an example of a cover 10 in accordance with a particular embodiment of the invention. FIG. 1 shows cover 10 in a closed position in which the wall-mounted device is hidden. Cover 10 has a support structure 100 and a face panel 110 attached to support structure 100. Face panel 110, in this example, includes a frame 112 surrounding an art area 114. Art area 114 can hold a photograph, painting, electronic display, or other decorative item.

Figure 2:
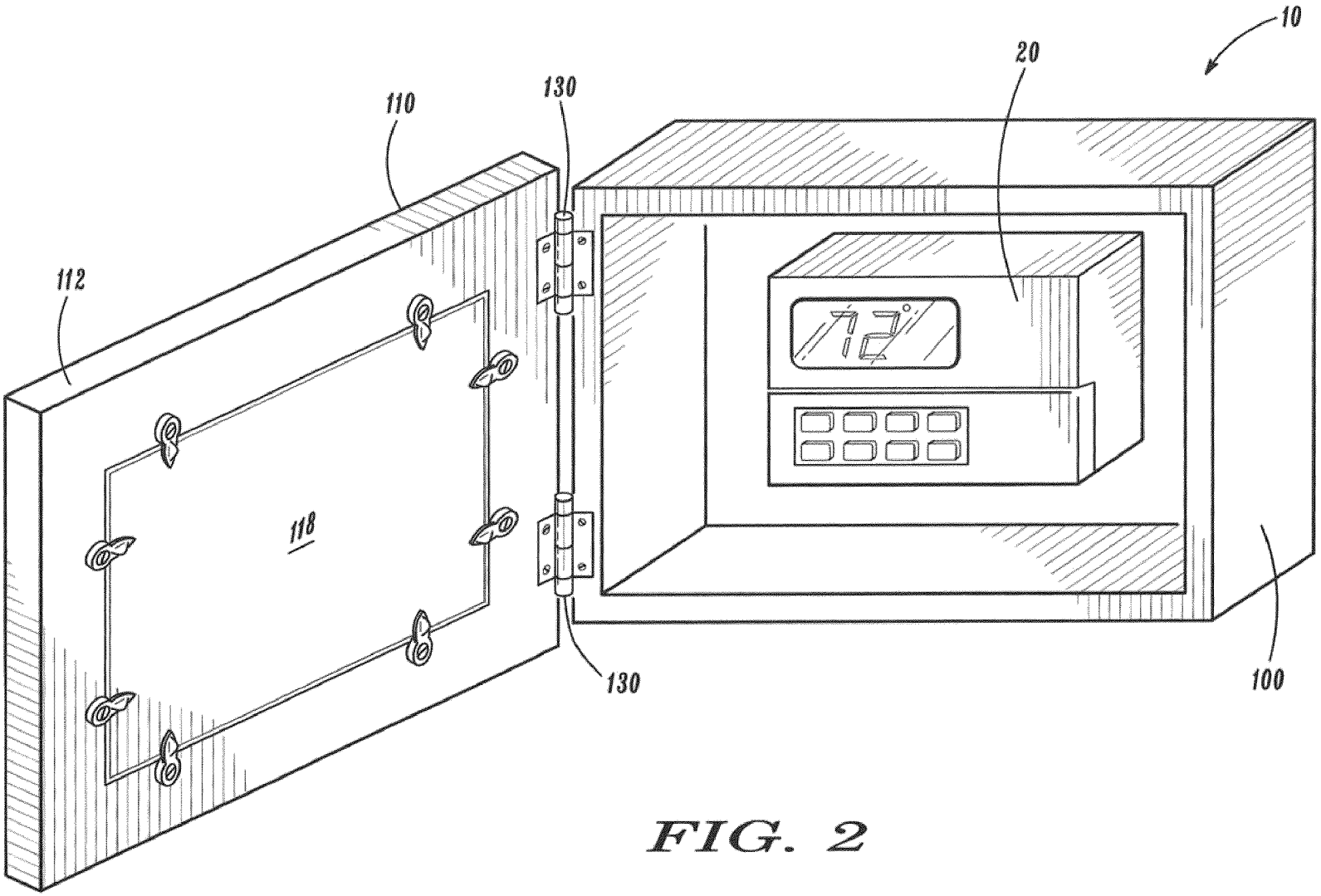
FIG. 2 is a perspective view of the embodiment shown in FIG. 1 in an open position to allow access to the thermostat.

FIG. 2 shows cover 10 in an open position allowing access to the wall-mounted device, in this example thermostat 20. Support structure 100 is sized appropriately to surround thermostat 20 and to allow opening of any access doors or panels of thermostat 20 to permit proper operation of thermostat 20. In this embodiment, face panel 110 has on its back side an access panel 118 that allows access to the art being displayed in art area 114. In the example shown in FIG. 2, face panel 110 is attached to support structure 100 by a pair of hinges 130 such that face panel 110 pivots sideways relative to support structure 100.

Figure 3:
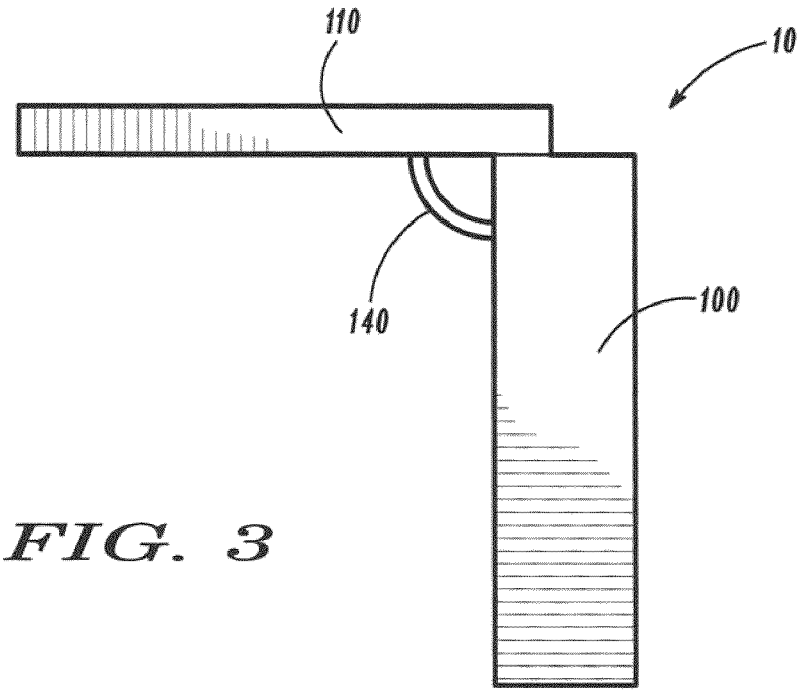
FIG. 3 is a side view of an embodiment of the invention.

FIG. 3 shows an example of the invention in which face panel 110 pivots vertically relative to support structure 100. In this example, a support 140 is provided to hold face panel 110 in the open position so that thermostat 20 can be accessed without the user having to hold face panel 110 in the open position. Support 140 can be a ratchet, a spring, or other holding device.

Figure 4:
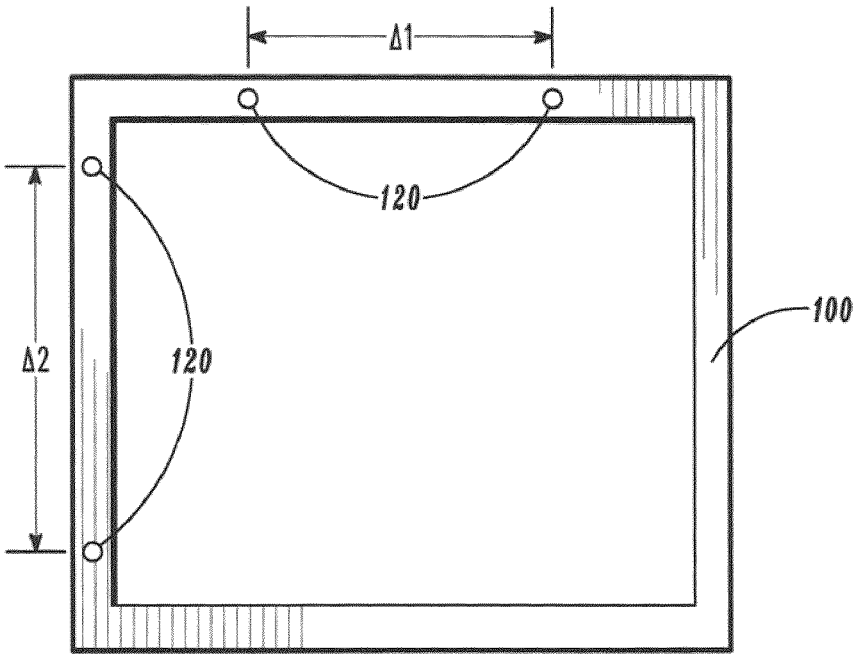
FIG. 4 is a back view of an embodiment of the invention.
Figure 5:
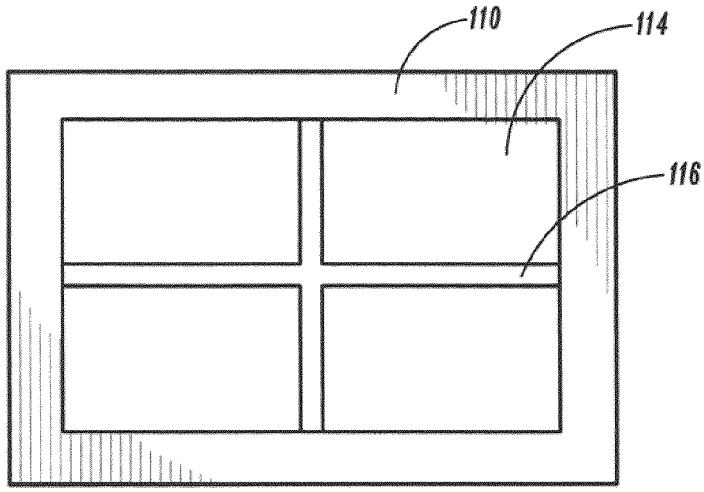
FIG. 5 is an front view of an embodiment of the invention.

Support structure 100 can be mounted to a wall in many different ways. For example, FIG. 4 shows a back side of support structure 100 being provided with multiple holes 120 for receiving nails driven into the wall. While the spacing, $\Delta 1$ and $\Delta 2$, of the holes can be any distance that provides secure support for cover 10, it is advantageous to space holes 120 such that $\Delta 1$ and $\Delta 2$ are equal. This allows cover 10 to be mounted in either a landscape or a portrait orientation without changing the spacing of the nails in the wall. This flexibility is desirable so that the orientation of cover 10 can be adjusted to suit artwork that is in both landscape and portrait orientations. FIG. 5 shows an example of the invention where art area 114 is divided into four areas by dividers 116. Although FIG. 5 shows four areas, any number and shape of areas can be provided. In addition, dividers 116 can be removable and a plurality of interchangeable dividers 116 can be provided.

Figure 6:
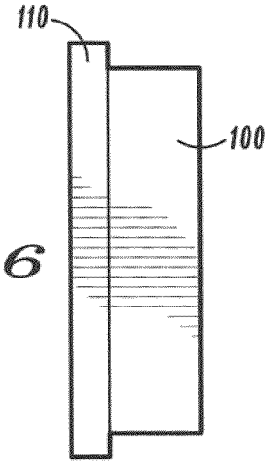
FIG. 6 is a side view of an embodiment of the invention.
Figure 7:
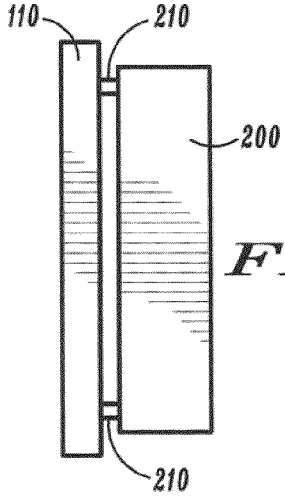
FIG. 7 is a side view of an embodiment of the invention.
Figure 8:
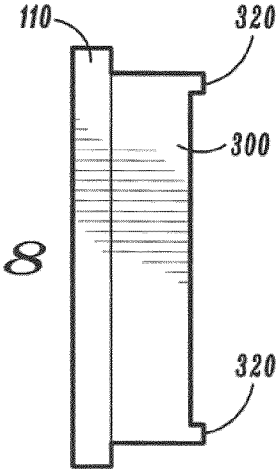
FIG. 8 is a side view of an embodiment of the invention.
Figure 9:
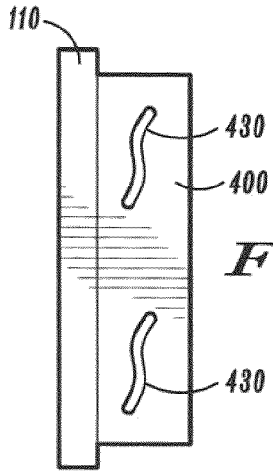
FIG. 9 is a side view of an embodiment of the invention.

If cover 10 is being used to cover a thermostat, it is important to provide sufficient airflow through the interior region of cover 10 so that the thermostat is subjected to air at a temperature that is equal to the temperature of the air outside of cover 10. This can be provided in several different ways. FIGS. 7-9 show examples of ways to provide the required air flow. FIG. 6 shows an embodiment having no ventilation holes in the sides, top or bottom of support structure 100. Such an embodiment is appropriate for covering wall-mounted devices that do not require air circulation. FIGS. 7-9 show examples of embodiments that provide air circulation. In the example of FIG. 7, face panel 110 is held away from support structure 200 by spacers 210 so that air can circulate between face panel 110 and support structure 200. Spacers 210 can be attached to either face panel 110 or support structure 200 and can be sized to provide sufficient airflow while still maintaining the desired ornamental appearance of cover 10. FIG. 8 shows an example in which legs 320 are provided on the back side of support structure 300 so that air can circulate between support structure 300 and the wall. FIG. 9 shows an example in which holes 430 are provided in support structure 400. In the example of FIG. 9, holes can also be provided in the top and bottom of support structure 400 to provide improved airflow.

While FIGS. 7-9 show particular structures for providing airflow, it is noted that any combination of these and/or other structures can be used to balance the need for airflow with the desired decorative appearance of cover 10.

Figure 10:
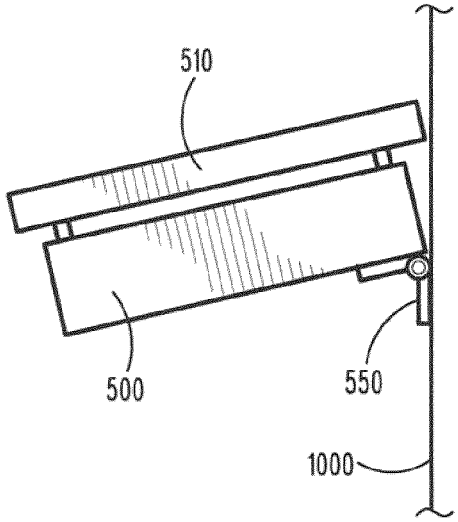
FIG. 10 is a side view of an embodiment of the invention.

FIG. 10 shows an embodiment of the invention in which the entire cover 10 is hinged relative to the wall 1000. In this example, face panel 510 is fixed to support structure 500 and support structure 500 is attached to wall 1000 by a hinge, or hinges, 550. This embodiment may be preferable for applications in which the thermostat, or other wall-mounted device, requires a large area when it is accessed, but requires only a small area when it is not being accessed. In addition, although only one hinge 550 is shown in FIG. 10, an additional hinge, or hinges, can be provided on a different edge of support structure 500 so that support structure 500 can be mounted on the wall in a different orientation.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art.

What is claimed is:

1. A decorative cover for a device mounted to a wall, the cover comprising:

a face panel having a decoration holder that is adapted to hold a decoration, the decoration holder having an openable access panel that when in an open position allows a first decoration to be removed and replaced by a second decoration; and a support structure attached to the face panel, the support structure being adapted to attach to the wall, the support structure and the face panel defining an inner area for surrounding the device, wherein the face panel is pivotable relative to the wall between a closed position and an open position, the open position allowing access to the device, and the cover has a top portion, the top portion having a top opening to allow air flow from an inner side of the top portion to an outer side of the top portion.

2. The cover of claim 1, wherein the top opening is between the support structure and the face panel.

3. The cover of claim 2, further comprising spacers located between the support structure and the face panel, the spacers creating the top opening.

4. The cover of claim 3, wherein the cover has a bottom portion, the bottom portion having a bottom opening to allow air flow from an inner side of the bottom portion to an outer side of the bottom portion.

5. The cover of claim 4, wherein the bottom opening is between the support structure and the face panel.

6. The cover of claim 5, further comprising bottom spacers located between the support structure and the face panel, the spacers creating the bottom opening.

7. The cover of claim 6, further comprising a hinge attached to the face panel and attached to the support structure, the hinge allowing the face panel to pivot relative to the support structure.

8. The cover of claim 7, further comprising a pair of first mounting areas located on a rear surface of a top portion of the support structure, the pair of first mounting areas being separated by a first distance and being for mounting the support structure to the wall.

9. The cover of claim 8, further comprising a pair of second mounting areas located on a rear surface of a side portion of the support structure, the pair of second mounting areas being separated by a second distance and being for mounting the support structure to the wall.

10. The cover of claim 9, wherein the second distance is equal to the first distance.

11. The cover of claim 6, further comprising a hinge attached to the support structure and adapted to attach to the wall, the hinge being for allowing the support structure to pivot relative to the wall.

12. The cover of claim 1, wherein the cover has a bottom portion, the bottom portion having a bottom opening to allow air flow from an inner side of the bottom portion to an outer side of the bottom portion.

13. The cover of claim 12, wherein the bottom opening is between the support structure and the face panel.

14. The cover of claim 13, further comprising bottom spacers located between the support structure and the face panel, the spacers creating the bottom opening.

15. The cover of claim 12, further comprising a hinge attached to the support structure and adapted to attach to the wall, the hinge being for allowing the support structure to pivot relative to the wall.

16. The cover of claim 12, further comprising a hinge attached to the face panel and attached to the support structure, the hinge allowing the face panel to pivot relative to the support structure.

17. The cover of claim 1, further comprising a hinge attached to the face panel and attached to the support structure, the hinge allowing the face panel to pivot relative to the support structure.

18. The cover of claim 1, wherein the decoration holder that is adapted to hold a photograph, and the openable access panel when in the open position allows a first photograph to be removed and replaced by a second photograph.

19. A decorative cover for a device mounted to a wall, the cover comprising:

a face panel; and a support structure attached to the face panel, the support structure being adapted to attach to the wall, wherein the face panel is pivotable relative to the wall between a closed position and an open position, and the cover has a top portion, the top portion having a top opening to allow air flow from an inner side of the top portion to an outer side of the top portion, wherein the cover has a bottom portion, the bottom portion having a bottom opening to allow air flow from an inner side of the bottom portion to an outer side of the bottom portion, and the support structure has a plurality of legs for contacting the wall, the legs creating the top opening and the bottom opening.

20. A decorative cover for a device mounted to a wall, the cover comprising:

a face panel;

a support structure attached to the face panel, the support structure being adapted to attach to the wall; and a hinge attached to the support structure and adapted to attach to the wall, the hinge being for allowing the support structure to pivot relative to the wall, wherein the face panel is pivotable relative to the wall between a closed position and an open position, and the cover has a top portion, the top portion having a top opening to allow air flow from an inner side of the top portion to an outer side of the top portion.

* * * * *